US006937219B2

(12) United States Patent
Chen et al.

(10) Patent No.: US 6,937,219 B2
(45) Date of Patent: Aug. 30, 2005

(54) PIXEL CIRCUIT FOR ACTIVE MATRIX OF CURRENT DRIVING DEVICE

(75) Inventors: Chain-Ru Chen, Ping-Tung (TW); Shang-Li Chen, Hsin-Chu (TW); Jun-Ren Shih, Chang-Hua (TW)

(73) Assignee: Industrial Technology Research Institute, Chu-Tung Chen (TW)

( * ) Notice: Subject to any disclaimer, the term of this patent is extended or adjusted under 35 U.S.C. 154(b) by 360 days.

(21) Appl. No.: 10/107,358

(22) Filed: Mar. 28, 2002

(65) Prior Publication Data

US 2003/0184509 A1 Oct. 2, 2003

(30) Foreign Application Priority Data

Mar. 22, 2002 (TW) ..... 91105501 A

(51) Int. Cl.[7] ..... G09G 3/36
(52) U.S. Cl. ..... 345/90; 345/76
(58) Field of Search ..... 345/76–104; 315/169.1

(56) References Cited

U.S. PATENT DOCUMENTS 6,501,466 B1 * 12/2002 Yamagishi et al. ..... 345/204
6,535,185 B2 * 3/2003 Kim et al. ..... 345/76
6,693,385 B2 * 2/2004 Koyama ..... 315/169.1

* cited by examiner

*Primary Examiner*—Sumati Lefkowitz
*Assistant Examiner*—Srilakshmi K Kumar

(57) ABSTRACT

The main differences between the present invention the conventional pixel circuit for active matrix of current driving device is the usage of the auxiliary transistor(s). In the invention, at least one auxiliary transistor is used to separate both the transistor, which is directly electrically coupled to the current driving device, and the plate, which is not directly electrically coupled with a constant voltage source, of the capacitor from the other transistors of the pixel circuit. Hence, all circuit and voltage, which are induced by the switching process of these transistors, are blocked or compensate by the auxiliary transistor(s), and the stored voltage of the capacitor would be unaffected.

36 Claims, 5 Drawing Sheets

| | | | | |
|---|---|---|---|---|
| The current delivered to the current driving device while all of the following transistors were turned on:the first transistor, the second transistor, and the third transistor | | 64nA | 640nA | 1000nA |
| The current delivered to the current driving device while all of the following transistors were turned off:the first transistor, the second transistor, and the third transistor | The prior art shown in Fig.1 | 51.33nA | 438.99nA | 699.41nA |
| | One embodiment of this invention shown in Fig.4 | 69.28nA | 638.59nA | 999.25nA |

FIG.5

PIXEL CIRCUIT FOR ACTIVE MATRIX OF CURRENT DRIVING DEVICE

BACKGROUND OF THE INVENTION

1. Field of the Invention

The present invention relates to the pixel circuit for active matrix of current driving device. More particularly, one important issue of this invnetion is how to reduce the variation of the current which is sent to the current driving device.

2. Description of the Prior Art

The current driving devices, such as the organic light emitting device (OLED) and the polymer emitting device (PLED), are getting more important in contemporary electronic devices. In general, in order to reduce consumed current and to prolong the lifetime, the conventional technique usually uses the pixel circuit of the active array to provide the current required by the current driving device.

As shown in FIG. 1, the conventional pixel circuit of active matrix at least has following elements: first transistor 11, second transistor 12, third transistor 13, fourth transistor 14, capacitor 15, and current driving device 16.

As shown in FIG. 1, the source and the gate of first transistor 11 are separately electrically coupled with first terminal 101 and second terminal 102. The drain and the gate of second transistor 12 are separately electrically coupled with the drain of first transistor 11 and third terminal 103. The source and the drain of third transistor 13 are separately electrically couple with constant voltage source (constant voltage source) 17 and the drain of first transistor 11. The source and the gate of fourth transistor 14 are separately electrically coupled with constant voltage source 17 and the gate of third transistor 13. Two plates of capacitor 15 are separated electrically coupled with constant voltage source 17 and the gate of third transistor 13. Current driving device 16 is electrically coupled with the drain of fourth transistor 14. Besides, for a complete array, first terminal 101 usually is electrically coupled with the data line which delivers the current signal, but second terminal 102 and third terminal 103 usually are electrically coupled with the scan line which delivers the voltage signal.

Clearly, whenever both first transistor 11 and second transistor 12 are turned on, the current delivered from constant voltage source 17 is delivered through both third transistor 13 and first transistor 11 into the data line. Besides, second transistor 12 also is turned and the voltage/charger is storaged in both third transistor 13 and capacitor 15, and then a current also is delivered through fourth transistor 14. In the mean time, because the gates of both transistors 13/14 are electrically coupled with capacitor 17, especially with the plate where voltage is different from the voltage of constant voltage source, a current mirror is formed. Herein, the current quantity ratio between third transistor 13 and fourth transistor 14 is directly proportional to the width-length-ratio ratio of these transistors 13/14, and the stored voltage of capacitor 15 is equal to the voltage difference between the age and the source of third transistor 13 (or fourth transistor 14). Hence, by adjusting the width-length-ratio of these transistors 13/14, or by adjusting the voltage which applied to the gates of these transistors 13/14 from the drain of second transistor 12, the current delivered to current driving device 16 could be properly controlled.

In contrast, whenever both first transistor 11 and second transistor 12 are turned off, no current could be delivered from constant voltage source 17 through third transistor 12 to any terminal, and no current could be delivered through the drain of second transistor 12 to turn on both third transistor 13 and fourth transistor 14. However, owing to capacitor 15 could maintain the stored voltage and apply it to the gates of both transistors 13/14, fourth transistor 14 still is turned on. In particularly, owing to the voltage different between two plates of capacitor 15 is equivalent to the difference between the gate and the source of third transistor 13 (four transistor 14) while both first transistor 11 and second transistor 12 are turned on, the current quantity delivered into current driving device after both first transistor 11 and second transistor are turned off would be equivalent to the current quantity delivered into current driving device while both first transistor 11 and second transistor are turned on.

However, the quality of any real element almost is different to that of the ideal element. For example, the parasitic capacitance between the gate and the source (or drain) of the real transistor usually is not zero, especially while the real transistor, such as OLED, being formed in and on the low temperature polysilicon substrate, any charger appears on the source and/or the drain would affect the real gate voltage. For example, for a turned-on real transistor, not only some chargers are located inside the gate for the existence of the parasitic capacitance but also some charges are located in the channel under the gate. Thus, while the real transistor being turned off, these chargers would not be constructed by the gate voltage and be delivered to both the source and the drain of the real transistor, and then an extra current is induced. These problems, usually are called as the switch effect or the charger coupled effect, would let practical application of the pixel circuit shown in FIG. 1 have two following defects:

First defect, while both first transistor 11 and second transistor 12 being turned off, the current delivered through third transistor 13 would be terminated. Thus, some chargers would be accumulated in and raise the voltage of the drain of third transistor 13. In the mean time, if the capacitance between the drain and the gate of third transistor 13 is irnegligible, the irnegligible capacitor would couple the chargers in the drain of third transistor 13 with capacitor 15 (or the plate where voltage is different from the voltage of constant voltage source 17) and let the stored voltage of capacitor 15 be changed.

Second defect, while both first transistor 11 and second transistor 12 being turned off, all chargers inside and under the gates of these transistors 11/12 would be delivered into the sources and the drains of these transistors 11/ 12. In this way, some chargers are delivered to the drain of third transistor and induce the previous defects, some chargers are directly delivered through the drain of second transistor 12 to capacitor 15, especially to the plate which is not directly coupled with constant voltage source 17, and change the stored voltage of capacitor 15.

Significantly, even the capacitance of the gate of each transistor is zero, even the quality of each transistor is alike to that of the ideal transistor, the switch effect of second transistor 12 still would change the stored voltage of capacitor 15. Moreover, if the gate capacitance of each transistor is irnegligible, the stored voltage of capacitor 15 would be strongly changed by the switch effect, or the turned off process, of both first transistor 11 and second transistor 12.

Accordingly, because the output of current driving device is strongly dependent on the inputted current, and because the current delivered through fourth transistor 14 to current driving device 16 is strongly controlled by the stored voltage of capacitor 15 for the gate of fourth transistor being electrically coupled with capacitor 15, how to ensure the stored voltage of capacitor 15 is stable and exact, especially is independent on the states of other transistors 11/12/13, is a red-hot and unsolved topic.

SUMMARY OF THE INVENTION

One object of this invention is to reduce, even eliminate, the switch effect's influence on the pixel circuit of the active matrix.

Another object of this invnetion is to reduce, even eliminate, the charger couple effect's influence on the current which is delivered to the current driving device.

Still an object is to stable the stored voltage of the capacitor, where the stored voltage could be used to control the current delivered to the current driving device.

The main differences between the present invention the conventional pixel circuit for active matrix of current driving device is the usage of the auxiliary transistor(s). In the invention, at least one auxiliary transistor is used to separate both the transistor, which is directly electrically coupled to the current driving device, and the plate, which is not directly electrically coupled with the constant voltage source, of the capacitor from the other transistors of the pixel circuit. Hence, all circuit and voltage, which are induced by the switching process of these transistors, are blocked or compensate by the auxiliary transistor(s), and then the stored voltage of the capacitor would not be obviously affected.

In the invnetion, accords to the real requirements, one auxiliary transistor or two auxiliary transistors are used. For example, while the parasitic capacitance is negligible, it is acceptable to only use one auxiliary transistor to separate the capacitor and the gate of the second transistor. For example, while the parasitic capacitance is main defect, it is acceptable to use only one auxiliary transistor to separate the capacitor and the gate of the third transistor. For example, while exact control of the inputted current of the current driving device is desired, it is acceptable to use two auxiliary transistors to separate the capacitor from both the gate of the second transistor and the gate of the third transistor.

BRIEF DESCRIPTION OF THE DRAWINGS

A more complete appreciation and many of the attendant advantages thereof will be readily obtained as the same becomes better understood by reference to the following detailed description when considered in connection with the accompanying drawings.

FIG. 5 shows some stimulated datas for comparing the present invention and the conventional technology.

DESCRIPTION OF THE PREFERRED EMBODIMENT

Figure 1:
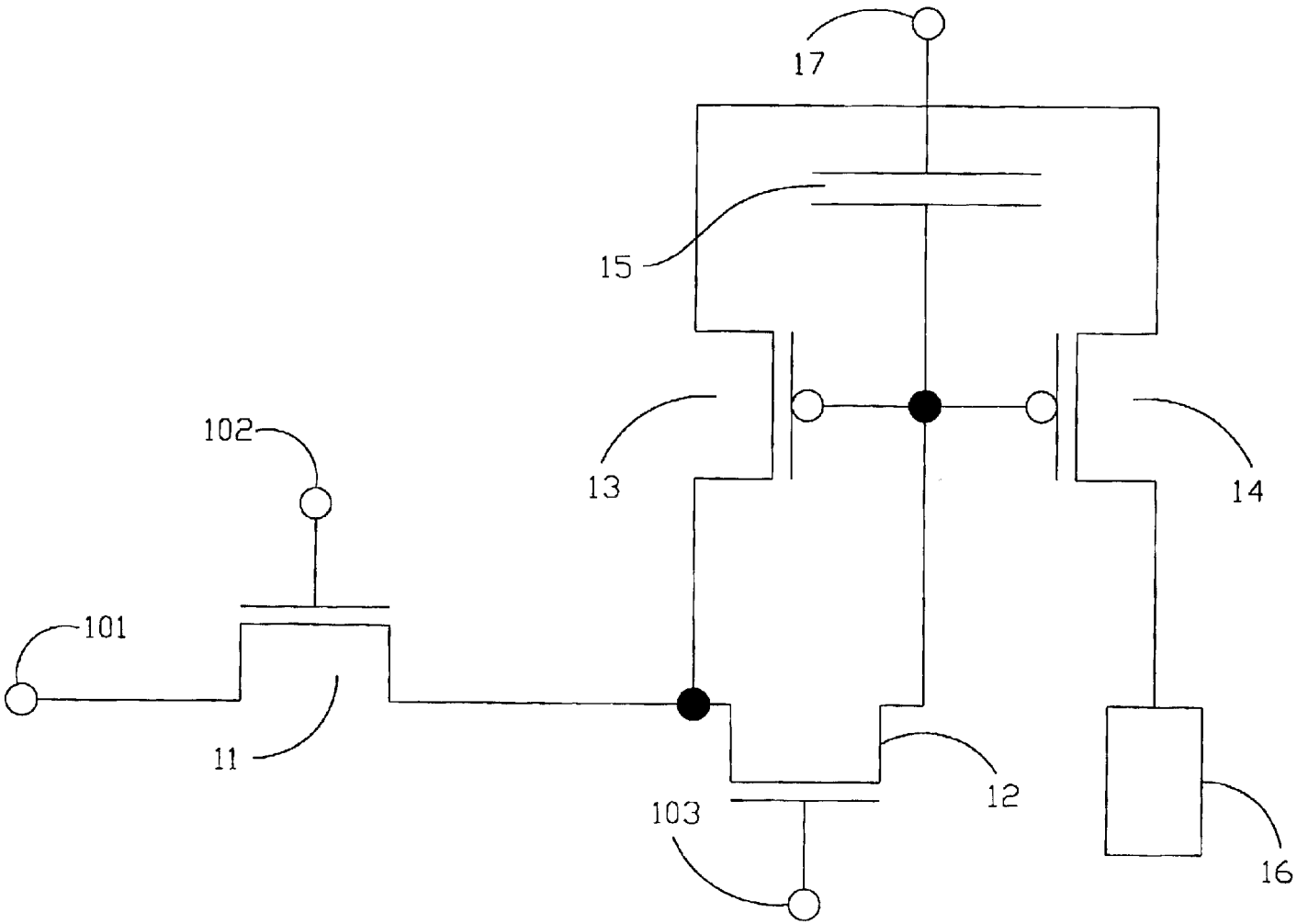
FIG.1(Prior Art)
FIG. 1 shows the essential circuit of the conventional pixel circuit of the active matrix.

First of all, the defect induced by the chargers/voltage/current from third transistor 13 is inquired. Because any charger/current/voltage in the drain and the source, even inside the gate, of third transistor would change the stored voltage of capacitor 15 by the irnegligible capacitance of the gate of third transistor 13, this present invention inserts an auxiliary transistor between third transistor and capacitor 15 (and the gate of fourth transistor 14). Herein, the auxiliary transistor is turned off before third transistor 13 is turned off to directly electrically separately the date of third transistor 13 and capacitor 15. Thus, the stored voltage of capacitor 15 would not be changed by any current/voltage/charger which is delivered from third transistor 13 and is induced by the switch effect of some transistors 11/12/13.

Next, the defect induced by the chargers/voltage/current from second transistor 12 is inquired. Because any charger/current/voltage delivered from the drain of transistor 13 would change the stored voltage of capacitor 15, this present invention inserts an auxiliary transistor between the drain of second transistor 12 and capacitor 15. Herein, the auxiliary transistor would be turned on while second transistor 12 being turned off (or turned on, decided by the conductive type of second transistor 12 and the auxiliary transistor). In this way, any charger/voltage/current delivered from the drain of second transistor 12 during the turned-off period of second transistor 12 would be compensated or neutralized by the auxiliary transistor and then the stored voltage of capacitor 15 would not be changed.

Certainly, this present invention could use two auxiliary transistors to solve the two defects at the same time. In the mean time, it is possible to let two auxiliary transistors compensate each other, it also is possible to incorporate partial these auxiliary transistors with the conventional technology to further simplify the present circuit.

One preferred embodiment of this present invention is a pixel circuit for the active matrix of the current driving device. As FIG. 2 shows, the embodiment at least has auxiliary transistor 20, first transistor 21, second transistor 22, third transistor 23, fourth transistor 24, capacitor 25, and current driving device 26, such as OLED or PLED.

Figure 2:
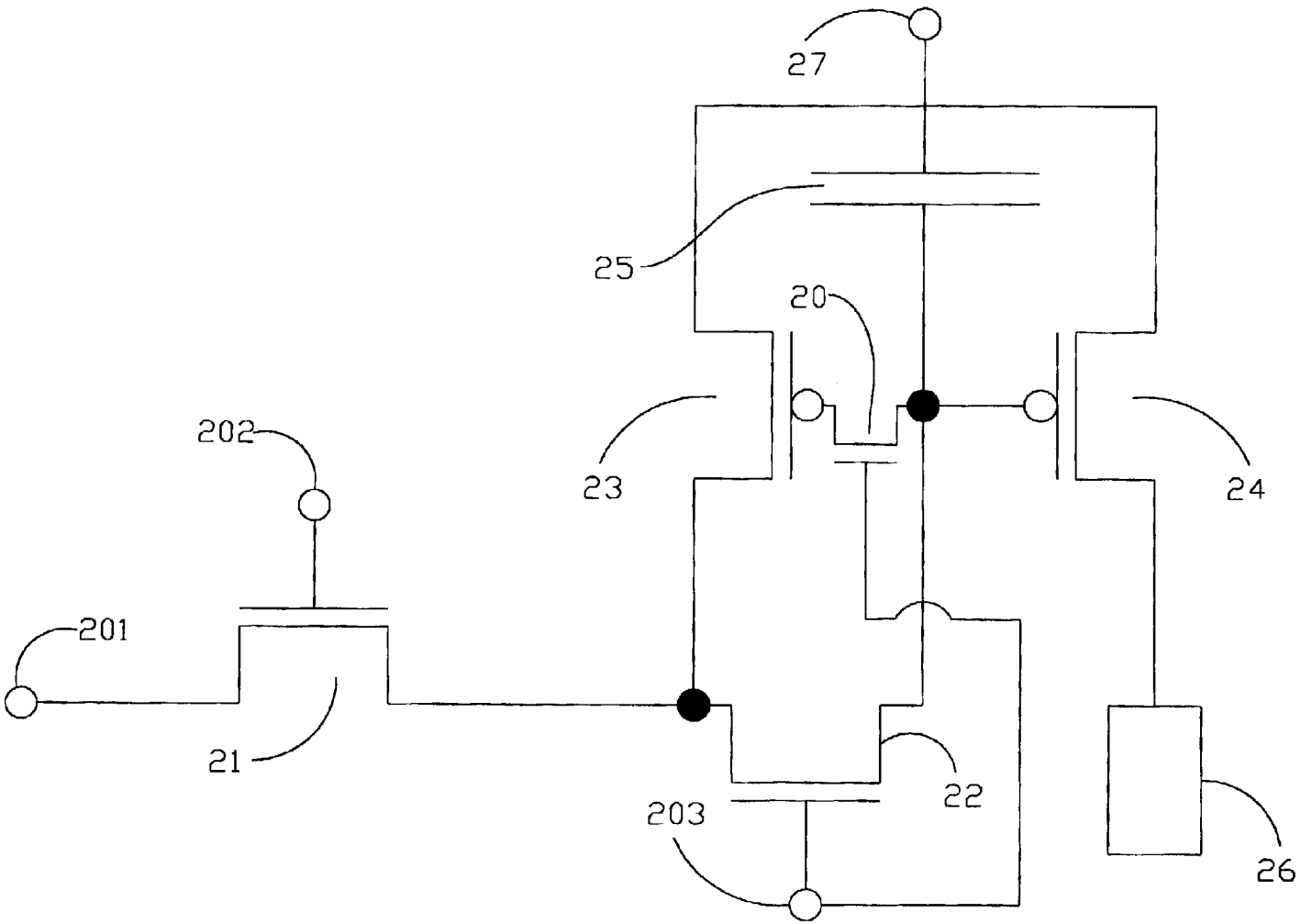
FIG. 2 shows the essential circuit of one present pixel circuit of the active matrix in according to one preferred embodiment of this invention.

As shown in FIG. 2, the source and the gate of first transistor 21 are separately electrically coupled with first terminal 201 and second terminal 202. The drain and the gate of second transistor 22 are separately electrically coupled with the drain of first transistor 21 and third terminal 203. The source and the drain of third transistor 23 are separately electrically couple with constant voltage source (constant voltage source) 27 and the drain of first transistor 21. The source and the gate of fourth transistor 24 are separately electrically coupled with constant voltage source 27 and the drain of auxiliary transistor 20. Two plates of capacitor 25 are separated electrically coupled with constant voltage source 27 and the gate of fourth transistor 24. Current driving device 26 is electrically coupled with the drain of fourth transistor 14. The source, the drain, and the gate of auxiliary transistor 20 are separately electrically coupled with the gate of third transistor 23, the gate of fourth transistor 24, and third terminal 203. Besides, for a complete array, first terminal 201 usually is electrically coupled with the data line which delivers the current signal, but second terminal 202 and third terminal 203 usually are electrically coupled with the scan line which delivers the voltage signal.

Clearly, by comparing FIG. 2 with FIG. 1, one main characteristic of this embodiment is auxiliary transistor 20 which is located between the gate of third transistor 23 and capacitor 25 (or the gate of fourth transistor 24). In the embodiment, auxiliary transistor 20 is turned of before third transistor 23 is turned off, and then any voltage/current/ chargers appear in the drain (even the source, the gate, and the channel under the gate) of third transistor 23 would not be delivered to capacitor 25, especially not to the plate which is directly electrically coupled with the gate of fourth transistor 24. Hence, anything induced by the turn-off process, even the turn-on process, of two transistors 21/22 would not be delivered through third transistor 23 and change the stored voltage of capacitor 25. Then, a direct result is the current delivered to current driving device 26 could be independent on the state of both first transistor 21 and second transistor 22.

Further, in order to form the current mirror, auxiliary transistor 20 must be turned on while both first transistor 21 and second transistor 22 are turned on. And it is necessary to avoid both capacitor 25 and fourth transistor 25 being affected by the voltage variation of both drain and gate of third transistor 33 while first transistor 21 is turned off. Therefore, in the embodiment, owing third signal could be used to control the sate of both auxiliary transistor 20 and second transistor 22, and also owing to second signal could be used to control the sate of first transistor 21, the phase of third signal usually is ahead of the phase of second phase. Thus, it is ensured that first transistor 21 is turned off after both second transistor 22 and auxiliary transistor 20 are turned off. Moreover, because no current is existent while the transistor is turned off, no current variation would appear while a turn off transistor is turned on. Thus, while second transistor 22, auxiliary transistor 20, and first transistor 20 all are turned off, which of them is firstly turned on is no important and is not important for the embodiment.

Besides, note that auxiliary transistor 20 would delivered chargers to its source and drain during the turn-off process, just as what second transistor 22 would done, some chargers would be directly delivered to the gate of fourth transistor 24 and capacitor 25. Moreover, note that the location of auxiliary transistor 20 could not any charger which is delivered from the drain of second transistor 22 to capacitor 25 while second transistor 22 being turned off. Therefore, the previous application of auxiliary transistor 20 could not thoroughly prevent the stored voltage of capacitor 25 from the influences of the switch effect.

Focus on the problem, the preferred embodiment presents a solution: let auxiliary transistor 20 and second transistor 22 be turned off at the same time, but let the conductive type of auxiliary transistor 20 is opposite to that of second transistor 22. Thus, electrons and holes are delivered to capacitor 25 and the gate of fourth transistor 24 simultaneously while they are turned off, and the neutralization between electrons and holes would let the stored voltage of capacitor 25 be not changed. Surely, this solution does not limit which of these transistors 20/22 is P-type transistor and which of these transistors 20/22 is N-type. Beside, to ensure thorough neutralization, the width-length-ratio of auxiliary transistor 20 is about equal to the width-length-ratio of second transistor 22.

Another preferred embodiment of this present invention also is a pixel circuit for the active matrix of the current driving device. As FIG. 3 shows, the embodiment at least has auxiliary transistor 30, first transistor 31, second transistor 32, third transistor 33, fourth transistor 34, capacitor 35, and current driving device 36, such as OLED or PLED.

Figure 3:
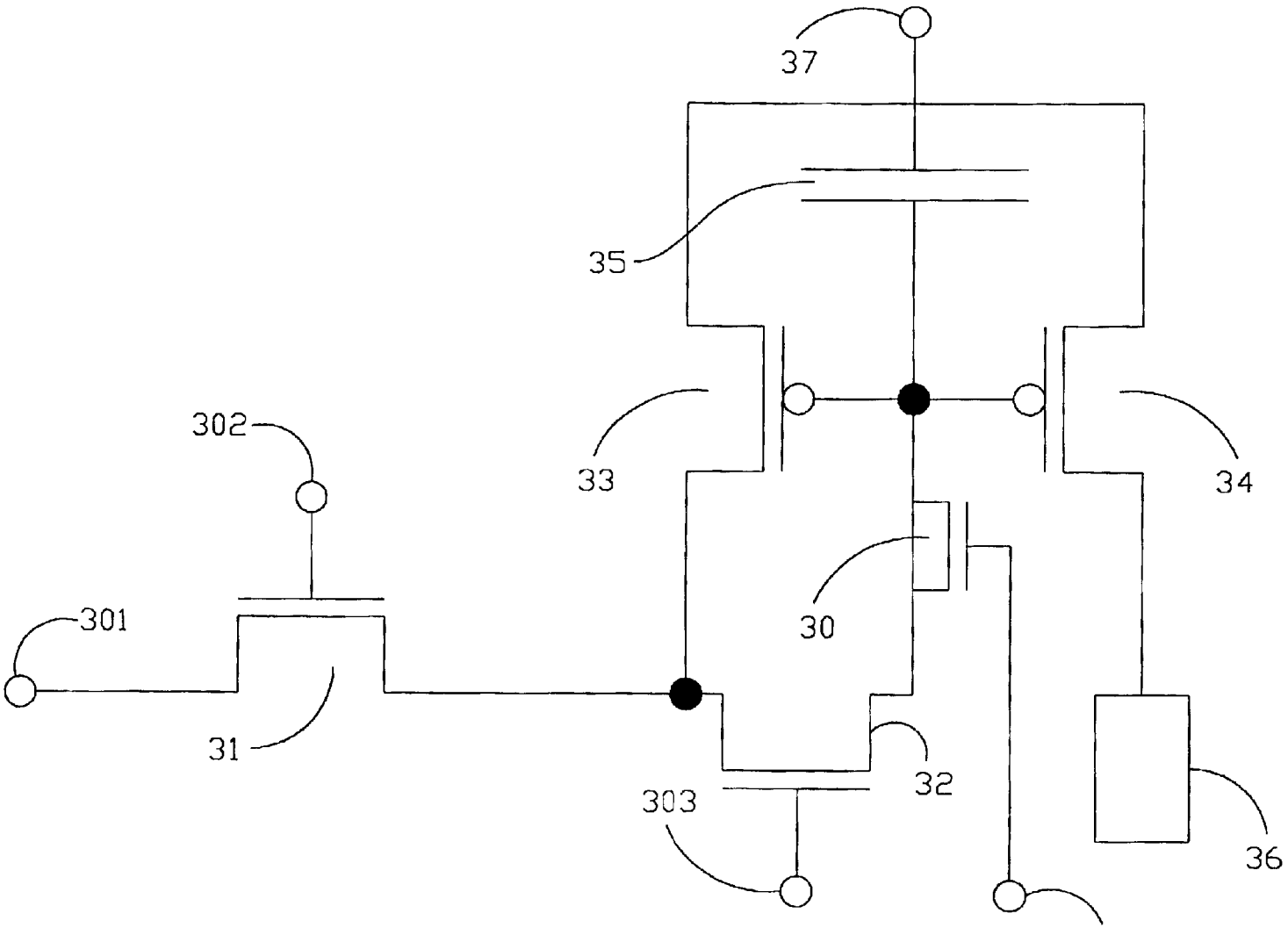
FIG. 3 shows the essential circuit of one present pixel circuit of the active matrix in according to another preferred embodiment of this invention.

As shown in FIG. 3, the source and the gate of first transistor 31 are separately electrically coupled with first terminal 301 and second terminal 302. The drain and the gate of second transistor 32 are separately electrically coupled with the drain of first transistor 31 and third terminal 303. The source and the drain of third transistor 33 are separately electrically couple with constant voltage source (constant voltage source) 37 and the drain of first transistor 31. The source and the gate of fourth transistor 34 are separately electrically coupled with constant voltage source 37 and the gate of third transistor 33. Two plates of capacitor 35 are separated electrically coupled with constant voltage source 37 and the gate of third transistor 33. Current driving device 36 is electrically coupled with the drain of fourth transistor 34. The source, the drain, and the gate of auxiliary transistor 30 are separately electrically coupled with the drain of third transistor 32, the gate of fourth transistor 34, and fourth terminal 304. Besides, for a complete array, first terminal 301 usually is electrically coupled with the data line which delivers the current signal, but second terminal 302, third terminal 303, and fourth terminal 304 usually are electrically coupled with the scan line which delivers the voltage signal.

Clearly, by comparing FIG. 3 with FIG. 1, one main characteristic of this embodiment is auxiliary transistor 30 which is located between the drain of second transistor 32 and capacitor 35 (or the gate of fourth transistor 34). In the embodiment, auxiliary transistor 30 is used to compensate (or neutralize or cancel) any charger, electron or hole, which is delivered from the drain of second transistor 32 during the turn-off process of second transistor 32, to ensure no voltage/current/charger induced by the turn-off process of second transistor 32 is delivered to capacitor 35, especial to the plate which is directly couple with the gate of fourth transistor 34. In this way, the stored voltage of capacitor 35 would not be changed, and then the current inputted to current driving device 26 would be independent on the states of second transistor 32.

In this embodiment, auxiliary transistor 30 could be a dummy transistor. Hence, the current always could be delivered through auxiliary transistor 30, no matter what is the gate voltage of auxiliary transistor 30. In contrast, because some chargers could be located in the gate and the channel, underlying the gate of the dummy transistor, and because the dummy transistor also has the parasitic capacitor between its gate and its source/drain, the turn-off process, even the turn-on process, of auxiliary transistor 30 also would deliver out and/or deliver in chargers. Then, it is possible to compensate/neutralize/cancel the chargers delivered from the drain of second transistor 32.

In this embodiment, it is possible to let the conductive type of auxiliary transistor 30 be equal to that of second transistor 32, and to let the third signal and the fourth signal be out of phase. Thus, the chargers delivered away the drain of second transistor 32 from during the turn-off process of second transistor 32 would be absorbed by the turn-on process of auxiliary transistor 32, and then the stored voltage of capacitor 35 would not be changed.

In this embodiment, it also is possible to let the conductive type of auxiliary transistor 30 be opposite to that of second transistor 32, one is N-type and another is P-type, and to let the third signal and the fourth signal be in phase. Thus, the chargers (electrons or holes) delivered away the drain of second transistor 32 from during the turn-off process of second transistor 32 would be neutralized by chargers (holes or electrons) delivered away the source of auxiliary transistor 32 during the turn-off process of auxiliary transistor 32, and then the stored voltage of capacitor 35 would not be changed.

In addition, chargers would be delivered through both the source and the drain of second transistor 32, but only the chargers delivered through the drain would be delivered to auxiliary transistor 32. Thus, the width-length-ratio of auxiliary transistor 30 usually is about half of that of second transistor 32.

The other preferred embodiment of this present invention still is a pixel circuit for the active matrix of the current driving device. As FIG. 3 shows, the embodiment at least has first transistor 31, second transistor 32, third transistor 33, fourth transistor 34, capacitor 35, and current driving device 36 (such as OLED or PLED), first auxiliary transistor 48, and second transistor 49.

Figure 4:
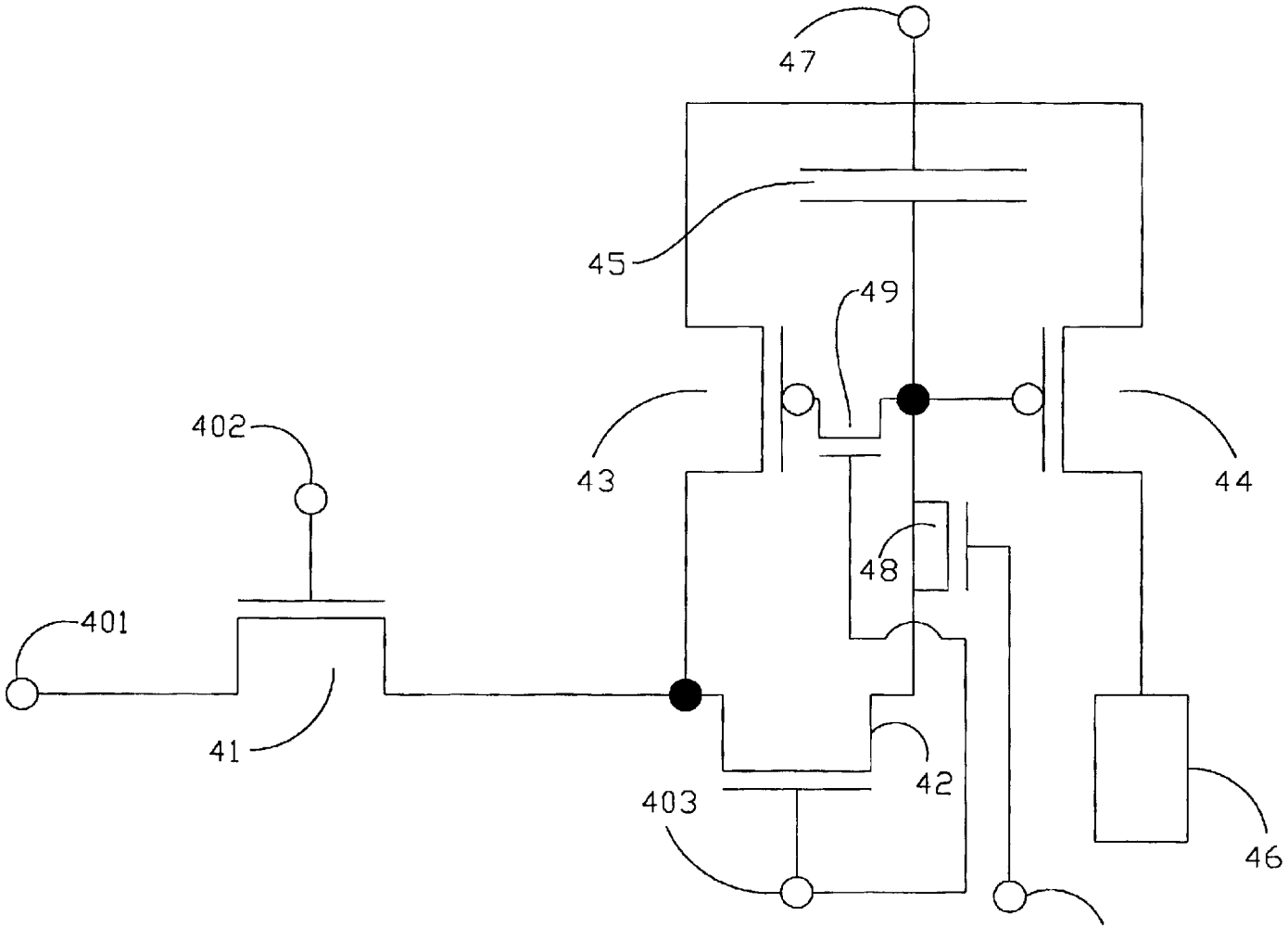
FIG. 4 shows the essential circuit of one present pixel circuit of the active matrix in according to the other preferred embodiment of this invention.

As shown in FIG. 4, the source and the gate of first transistor 41 are separately electrically coupled with first terminal 401 and second terminal 402. The drain and the gate of second transistor 42 are separately electrically coupled with the drain of first transistor 41 and third terminal 403. The source and the drain of third transistor 43 are separately electrically couple with constant voltage source (constant voltage source) 47 and the drain of first transistor 41. The source and the gate of fourth transistor 44 are separately electrically coupled with constant voltage source 47 and the drain of second auxiliary transistor 49. Two plates of capacitor 45 are separated electrically coupled with constant voltage source 47 and the gate of fourth transistor 44. Moreover, the source, the drain and the gate of first auxiliary transistor 48 is separately electrically coupled with the drain of second transistor 42, the gate of fourth transistor 44, and fourth terminal 404. The source, the drain and the gate of second auxiliary transistor 49 is separately electrically coupled with the gate of third transistor 43, the gate of fourth transistor 44, and third terminal 403. Current driving device 46 is electrically coupled with the drain of fourth transistor 44. Besides, for a complete array, first terminal 301 usually is electrically coupled with the data line which delivers the current signal, but second terminal 302, third terminal 303, and fourth terminal 304 usually are electrically coupled with the scan line which delivers the voltage signal.

Clearly, by comparing FIG. 4 with both FIG. 2 and FIG. 3, first auxiliary transistor 48 is equal to auxiliary transistor 30, and second auxiliary transistor 49 is equal to auxiliary transistor 40. In other words, this embodiment uses two auxiliary transistors 48/49 (30/30) at the same time. Moreover, to ensure the stored voltage of capacitor 47 would not be changed by the sates of transistors 41/42/43 and by the turn-off process, even turn-on process, of transistors 41/42, both the plate, which is not directly coupled with constant voltage source 47, and the gate of fourth transistor 44 are separated from other transistors 41/42/43 by the existence of two auxiliary transistors 48/49, In this preferred embodiment, it is possible to let first auxiliary transistor 48, second auxiliary transistor 49, and second transistor 42 have the same conductive type, and to let the third signal and the fourth signal be out of phase. Thus, all chargers delivered away both second transistor 42 and second auxiliary transistor 49 during their turn-off process would be compensated (absorbed) by first auxiliary transistor 48. Of course, it also is possible to let the conductive type of first auxiliary transistor 48 is opposite to that of both second auxiliary transistor 49 and second transistor 42, and to let the third signal and the fourth signal be in phase. Thus, all chargers delivered away both second transistor 42 and second auxiliary transistor 49 during their turn-off process would be compensated (neutralized) by first auxiliary transistor 48.

Besides, it also is possible to let the phase of the third signal is ahead of the phase of the second signal, to let first transistor 41 be turned off only after both second transistor 43 and second auxiliary transistor 49 are turned off. Thus, any variation induced by the capacitance in the gate of third transistor would not be delivered to both capacitor 47 and the gate of fourth transistor 44. Herein, while all of second transistor 42, second auxiliary transistor 49, and first transistor 41 are turned off, which of them is firstly turned on is not important for the embodiment.

Further, note that second auxiliary transistor 49 would deliver charger(s) to the drain of first auxiliary transistor 48, and second transistor 42 would deliver charger(s) to the source of first auxiliary transistor 48. Thus, to ensure all appeared chargers are totally compensated, it is possible the width-length ratio of first auxiliary transistor 48 be about equal to of the width-length ratio of second transistor 42 and be about equal to the width-length ratio of second auxiliary transistor 49.

Furthermore, because all pixel circuits present by this invention are used to provide required current to current driving device 26/36/46, and it is desired to raise the proportion current is delivered from constant voltage source 27/37/47 to current driving device 26/36/46. The width-length-ratio of first transistor 21/31/41 usually is smaller than that of fourth transistor 24/34/44, the width-length-ratio of third transistor 23/33/43 also usually is smaller than that of fourth transistor. Herein, under the limitation that the load of the present pixel circuit must be balanced, the ratio should be as smaller as possible.

Finally, to express the advantages of this present invention, FIG. 5 shows the simulated results of both the embodiment shown in FIG. 4 and the conventional technology shown in FIG. 1. Herein, the simulated model is the ERSO LTPS mode, and the simulation is performed to calculate the current which is delivered to the current driving device after the initially turned-on transistors being turned off. Moreover, three initially current which are inputted to the current driving device while the initially turned-on transistors were turned on are simulated: 64 nA, 640 na, and 1000 nA. Further, to reduce the effect of the channel length modulation and to enhance the effect of the current mirror, the simulation applies a 2 Volts voltage on the terminal, which is not directly connected with fourth transistor, of the current driving device, such as the anode of the OLED. By referring to FIG. 5, this present invention really could effectively reduce the change of the current which is delivered to the current driving device, and the improving degree is proportional to the quantity of inputted current.

Obviously, numerous additional modifications and variations of the present invention are possible in light of the above teachings. It is therefore to be understood that within the scope of the appended claims, the invention may be practiced otherwise than as specifically described herein.

What is claimed is:

1. An pixel circuit for active matrix of current driving devices, comprising:

a first transistor, the source and the gate of said first transistor being separately electrically coupled with a first terminal and a second terminal;

a second transistor, the source and the gate of said second transistor being separately electrically coupled with the drain of said first transistor and a third terminal;

a third transistor, the source and drain of said third transistor being separately electrically coupled with a constant voltage source and the drain of said first transistor;

a fourth transistor, the source and the gate of said fourth transistor being separately electrically coupled with said constant voltage source and the gate of said third transistor;

an auxiliary transistor, the source, the drain and the gate of said auxiliary transistor being separately electrically coupled with the drain of said second transistor, the gate of said third transistor, and a fourth terminal;

a capacitor, one plate of said capacitor being electrically coupled with said constant voltage source and another plate of said capacitor being electrically coupled with the gate of said fourth transistor; and a current driving device, said current driving device being electrically coupled with the drain of said fourth transistor.

2. The pixel circuit of claim 1, a first signal inputted from said first terminal being a current signal.

3. The pixel circuit of claim 1, each of the following being a voltage signal: a second signal inputted from said second terminal, a third signal inputted from said third terminal, and a fourth signal inputted from said fourth terminal.

4. The pixel circuit of claim 1, said auxiliary transistor being a dummy transistor.

5. The pixel circuit of claim 1, the source of said auxiliary transistor being electrically coupled with the drain of said auxiliary transistor.

6. The pixel circuit of claim 4, the conductive type of said second transistor being equal to the conductive type of said dummy transistor.

7. The pixel circuit of claim 4, said third signal being out of the phase of said fourth signal.

8. The pixel circuit of claim 4, the width-length-ratio of said dummy transistor being about half of the width-length-ratio of said second transistor.

9. The pixel circuit of claim 4, the conductive type of said second transistor being different to the conductive type of said dummy transistor, one is a P-type transistor and another is an N-type transistor.

10. The pixel circuit of claim 9, said third signal being in the phase of said fourth signal.

11. The pixel circuit of claim 9, the width-length-ratio of said dummy transistor being about half of the width-length-ratio of said second transistor.

12. The pixel circuit of claim 1, the width-length-ratio of said first transistor being smaller than the width-length-ratio of said fourth transistor.

13. The pixel circuit of claim 1, the width-length-ratio of said third transistor being smaller than of the width-length-ratio of said fourth transistor.

14. The pixel circuit of claim 1, said current driving device being chosen from the group consisting of the organic light emitting device and the polymer light emitting device.

15. An pixel circuit for active matrix of current driving devices, comprising:

a first transistor, the source and the gate of said first transistor being separately electrically coupled with a first terminal and a second terminal;

a second transistor, the source and the gate of said second transistor being separately electrically coupled with the drain of said first transistor and a third terminal;

a third transistor, the source and drain of said third transistor being separately electrically coupled with a constant voltage source and the drain of said first transistor;

a fourth transistor, the source and the gate of said fourth transistor being separately electrically coupled with said constant voltage source and the drain of said second transistor;

an auxiliary transistor, the source, the drain and the gate of said auxiliary transistor being separately electrically coupled with the gate of said third transistor, the gate of said fourth transistor, and said third terminal;

a capacitor, one plate of said capacitor being electrically coupled with said constant voltage source and another plate of said capacitor being electrically coupled with the gate of said fourth transistor; and a current driving device, said current driving device being electrically coupled with the drain of said fourth transistor.

16. The pixel circuit of claim 15, a first signal inputted from said first terminal being a current signal.

17. The pixel circuit of claim 15, each of the following being a voltage signal: a second signal inputted from said second terminal and a third signal inputted from said third terminal.

18. The pixel circuit of claim 15, the phase of said third signal being ahead of the phase of second signal to let said first transistor be turned off after both said second transistor and said auxiliary transistor be turned off.

19. The pixel circuit of claim 15, the conductive type of said second transistor being different to the conductive type of said dummy transistor, one is a P-type transistor and another is an N-type transistor.

20. The pixel circuit of claim 19, the width-length-ratio of said dummy transistor being about equal to the width-length-ratio of said second transistor.

21. The pixel circuit of claim 15, the width-length-ratio of said first transistor being smaller than the width-length-ratio of said fourth transistor.

22. The pixel circuit of claim 15, the width-length-ratio of said third transistor being smaller than of the width-length-ratio of said fourth transistor.

23. The pixel circuit of claim 15, said current driving device being chosen from the group consisting of the organic light emitting device and the polymer light emitting device.

24. An pixel circuit for active matrix of current driving devices, comprising:

a first transistor, the source and the gate of said first transistor being separately electrically coupled with a first terminal and a second terminal;

a second transistor, the source and the gate of said second transistor being separately electrically coupled with the drain of said first transistor and a third terminal;

a third transistor, the source and drain of said third transistor being separately electrically coupled with a constant voltage source and the drain of said first transistor;

a fourth transistor, the source of said fourth transistor being electrically coupled with said constant voltage source;

an first auxiliary transistor, the source, the drain and the gate of said first auxiliary transistor being separately electrically coupled with the drain of said second transistor, the gate of said third transistor, and a fourth terminal;

an second auxiliary transistor, the source, the drain and the gate of said second auxiliary transistor being separately electrically coupled with the gate of said third transistor, the gate of said fourth transistor, and said third terminal;

a capacitor, one plate of said capacitor being electrically coupled with said constant voltage source and another plate of said capacitor being electrically coupled with the gate of said fourth transistor; and a current driving device, said current driving device being electrically coupled with the drain of said fourth transistor.

25. The pixel circuit of claim 24, a first signal inputted from said first terminal being a current signal.

26. The pixel circuit of claim 24, each of the following being a voltage signal: a second signal inputted from said second terminal, a third signal inputted from said third terminal, and a fourth signal inputted from said fourth terminal.

27. The pixel circuit of claim 24, the conductive type of said first auxiliary transistor being equal to the conductive type of said second auxiliary transistor, and also being equal to the conductive type of said second transistor.

28. The pixel circuit of claim 27, said third signal and said fourth signal be out of the phase.

29. The pixel circuit of claim 24, the conductive type of said first auxiliary transistor being different to the conductive type of said second auxiliary transistor, and also being different to the conductive type of said second transistor.

30. The pixel circuit of claim 29, said third signal being and said fourth signal being in phase.

31. The pixel circuit of claim 24, the width-length-ratio of said second transistor being about equal to the width-length-ratio of said first auxiliary transistor.

32. The pixel circuit of claim 24, the width-length-ratio of said second auxiliary transistor being about equal to the width-length-ratio of said first auxiliary transistor.

33. The pixel circuit of claim 24, the phase of said third signal being ahead of the phase of second signal to let said first transistor be turned off after both said second transistor and said auxiliary transistor be turned off.

34. The pixel circuit of claim 24, the width-length-ratio of said first transistor being smaller than the width-length-ratio of said fourth transistor.

35. The pixel circuit of claim 24, the width-length-ratio of said third transistor being smaller than of the width-length-ratio of said fourth transistor.

36. The pixel circuit of claim 24, said current driving device being chosen from the group consisting of the organic light emitting device and the polymer light emitting device.

* * * * *